US007946036B2

(12) United States Patent
Beamer et al.

(10) Patent No.: US 7,946,036 B2
(45) Date of Patent: May 24, 2011

(54) METHOD OF MANUFACTURING A MANIFOLD FOR A HEAT EXCHANGER

(75) Inventors: Henry Earl Beamer, Middleport, NY (US); William L. Leacock, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 1271 days.

(21) Appl. No.: 11/528,870

(22) Filed: Sep. 28, 2006

(65) Prior Publication Data

US 2008/0078541 A1 Apr. 3, 2008

(51) Int. Cl.

| | |
|---|---|
| ***B21D 51/38*** | (2006.01) |
| ***B21D 21/00*** | (2006.01) |
| ***B23K 31/00*** | (2006.01) |
| ***B21C 37/06*** | (2006.01) |

(52) U.S. Cl. ..... 29/890.052; 29/890.053; 29/890.054; 29/890.036; 29/890.03; 72/368

(58) Field of Classification Search ..... 29/890.052, 29/890.053, 890.054, 890.036, 890.04, 890.05, 29/890.03; 165/173–176; 72/51, 367.1, 368, 369

See application file for complete search history.

(56) References Cited

U.S. PATENT DOCUMENTS

| | | | | |
|---|---|---|---|---|
| 1,684,083 | A | 9/1928 | Bloom | 62/525 |
| 5,174,373 | A * | 12/1992 | Shinmura | 165/176 |
| 6,012,315 | A * | 1/2000 | Sekido et al. | 72/51 |
| 7,275,394 | B2 * | 10/2007 | Lundberg | 62/515 |

* cited by examiner

*Primary Examiner* — David P Bryant
*Assistant Examiner* — Sarang Afzali
(74) *Attorney, Agent, or Firm* — Patrick M. Griffin

(57) ABSTRACT

A manifold for a heat exchanger includes a header radially surrounding and in spaced relationship to an axially extending distributor conduit. The distributor conduit is formed by bending the sheet along the leading edge, and the header is formed by bending a remainder of the sheet including a trailing edge about an axis in radially spaced relationship to the distributor conduit. The cross sections are completed and closed by placing the leading and trailing edges into contact with, and sealing the edges to the sheet.

3 Claims, 5 Drawing Sheets

FIG - 11
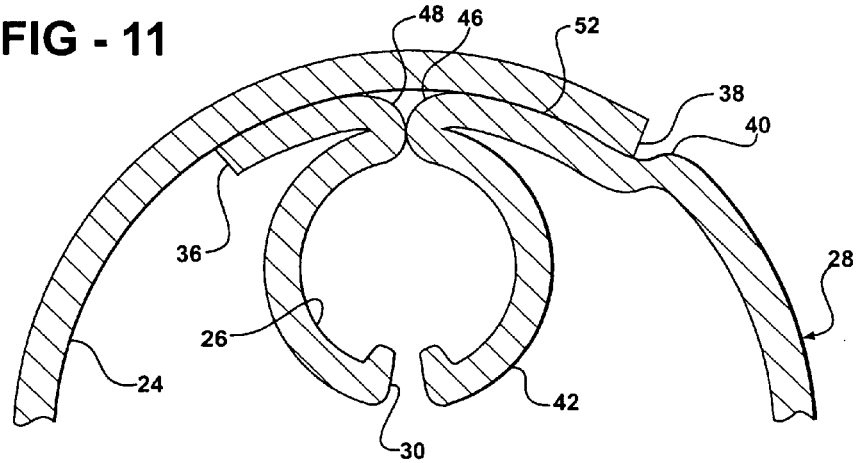
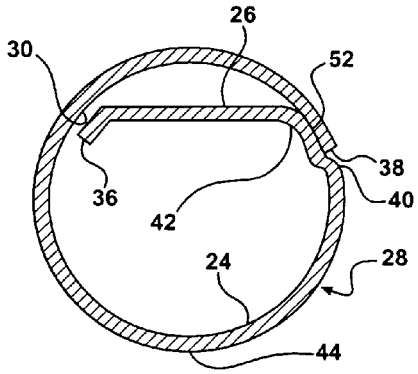
FIG - 12
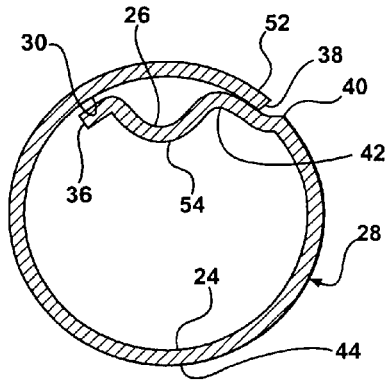
FIG - 13
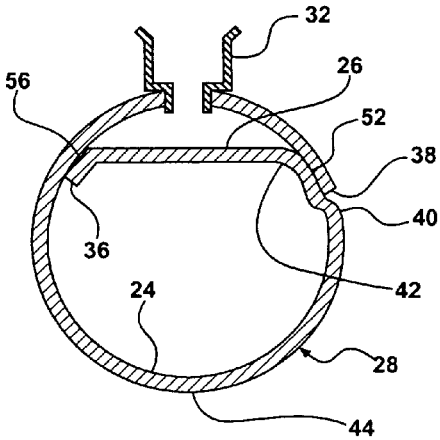
FIG - 14
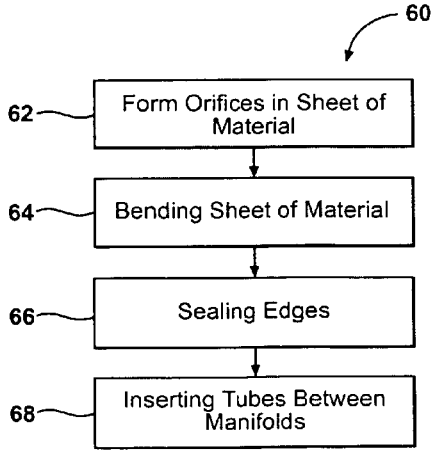
FIG - 15

METHOD OF MANUFACTURING A MANIFOLD FOR A HEAT EXCHANGER

BACKGROUND OF THE INVENTION

1. Field of the Invention

The subject invention relates generally to a method of fabricating a heat exchanger. The subject invention relates specifically to a method of fabricating a heat exchanger having a manifold of the type including a header and a distributor conduit positioned radially within the manifold wherein the distributor conduit further includes orifices for fluid communication with the manifold.

2. Description of the Prior Art

Various types of heat exchanger manifolds are generally known in the prior art which include a distributor located radially within and fluidly connected with a header. An example of this is shown in U.S. Pat. No. 1,684,083 to S. C. Bloom.

The Bloom patent discloses a refrigerating coil having a fluid distributing tube arranged centrally within inlet manifold. The fluid distributing tube includes a plurality of outlets providing a uniform distribution of refrigerant throughout the length of the manifold. Furthermore, the fluid distributing tube is supported within the manifold by one or more lugs welded at each end to hold it in place.

Therefore, the prior art heat exchanger manifold is constructed in two pieces and welded together. This is an expensive, laborious, and hence undesirable process for constructing a heat exchanger to satisfy current expectations. Thus, there is a need for an improved heat exchanger manifold that is easier and less expensive to manufacture, overcoming these and other disadvantages.

SUMMARY OF THE INVENTION AND ADVANTAGES

A method of fabricating a manifold for a heat exchanger is provided. The method includes bending a sheet of material about an axis to form a distributor conduit and a header. The header and distributor conduit extend axially. The header radially surrounds the distributor conduit in radially spaced relationship.

A method of fabricating a manifold for a heat exchanger is provided. The heat exchanger includes a header extending axially and radially surrounding an axially extending distributor conduit. The method includes bending at least a first portion of the cross sectional periphery of the distributor conduit along a leading edge of a sheet of material having a trailing edge. The header is formed by bending the sheet about an axis in radially spaced relationship to the distributor conduit. The edges are sealed to the sheet axially therealong.

A method of fabricating a heat exchanger is also provided. The heat exchanger includes a manifold having a header extending axially and radially surrounding an axially extending distributor conduit. The distributor conduit includes orifices for fluid communication with the header. Tubes extend between the manifolds. The method includes forming the orifices along a sheet of material having a leading edge parallel to a trailing edge. The manifold is formed by bending at least a first portion of the cross-sectional periphery of the distributor conduit along the leading edge, and bending the sheet about an axis in radially spaced relationship to the distributor conduit. The leading and trailing edges are placed into contact with and sealed to the sheet. Tubes are inserted into the manifolds to establish fluid flow.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 11 is a cross section of the third exemplary embodiment taken along a line similar to 2-2 of FIG. 1 showing an orifice;

FIG. 12 is a cross section of an exemplary manifold similar to the fourth exemplary embodiment taken along a line similar to 2-2 of FIG. 1 showing an orifice;

FIG. 13 is a cross section of the third exemplary embodiment taken along a line similar to 2-2 of FIG. 1 showing an orifice;

FIG. 14 is a cross sectional view of a manifold with distributor conduit access in accordance with the present invention;

FIG. 15 is a block diagram showing a method of fabricating a heat exchanger in accordance with the first exemplary embodiment of the present invention;

DETAILED DESCRIPTION OF THE INVENTION

Figure 1:
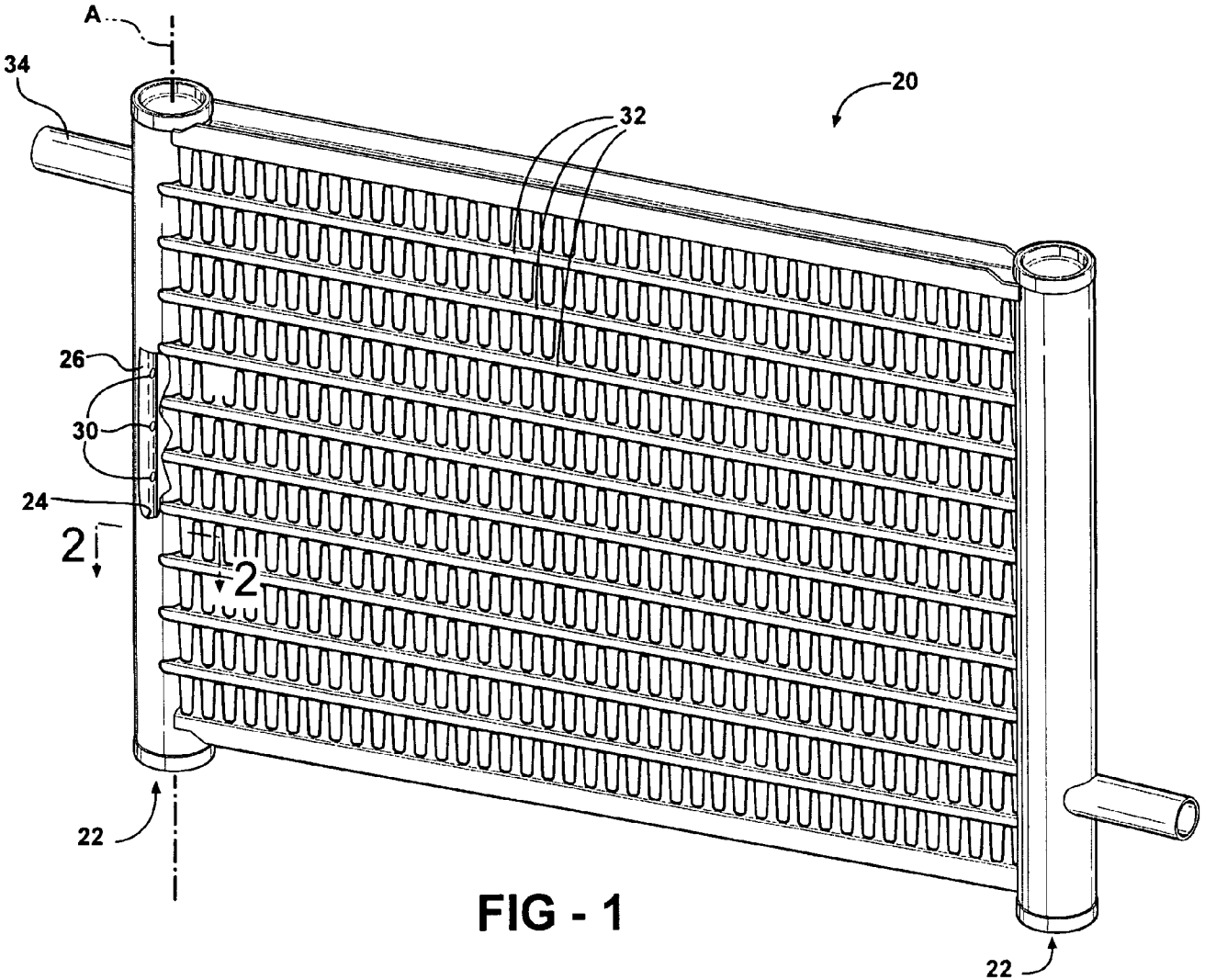
FIG. 1 is a heat exchanger fabricated in accordance with the present invention.

Referring to the Figures, wherein like numerals indicate corresponding parts throughout the several views, a heat exchanger is shown generally at 20. Referring first to FIG. 1, the heat exchanger 20 includes a pair of manifolds 22, at least one of which has a header 24 surrounding a distributor conduit 26. A single integral sheet 28 of material extends through both the header 24 and distributor conduit 26 to define the manifold 22. According to a first exemplary embodiment, the material comprises aluminum. However, any suitable material could be substituted, including polymers or metals such as steel or copper. The distributor conduit 26 includes a plurality of orifices 30 for fluid communication with the header 24. A plurality of tubes 32 extend between the manifolds 22, a coolant enters the distributor conduit 26 through an external coupler 34, flows through the orifices 30 to the header 24 and then into the tubes 32 toward the adjacent manifold 22.

Referring generally to FIGS. 2-14, the sheet 28 includes a leading edge 36 and defines at least a first portion of the distributor conduit 26. Generally, the leading edge 36 engages the sheet 28 to define the distributor conduit 26. The sheet 28 further includes a trailing edge 38 and extends about an axis A. The sheet 28 is radially spaced from the distributor conduit 26. The trailing edge 38 of the sheet 28 engages the sheet 28 to define the header 24. A leading shoulder 40 extends axially along the sheet 28 in spaced relationship to the leading edge 36. Additionally, a first bend 42 is placed between the leading shoulder 40 and the leading edge 36 to define at least the first portion of the distributor conduit 26. A second bend 44 is placed between the leading shoulder 40 and the trailing edge 38 to define the header 24.

Figure 2:
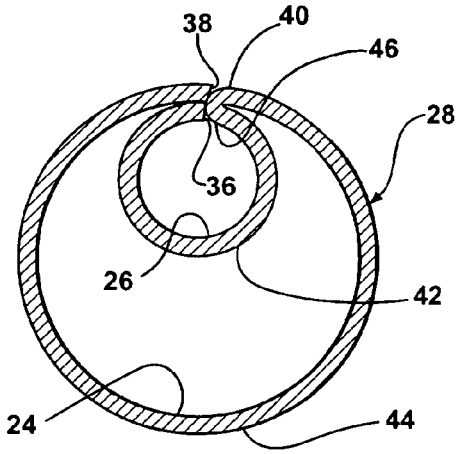
FIG. 2 is a cross section taken along line 2-2 of FIG. 1 showing a first exemplary embodiment of a manifold fabricated in accordance with the present invention.

According to the first exemplary embodiment, a first fold 46 extends axially along the sheet 28 in spaced relationship to the leading edge 36. The first fold 46 has a substantially "U"-shape as viewed in cross section and incorporates the leading shoulder 40. The first bend 42 is more specifically placed between the first fold 46 and the leading edge 36 to define at least the first portion of the distributor conduit 26. Thus, the leading edge 36 extends beneath the trailing edge 38 and abuts against the leading shoulder 40 of the first fold 46 to define the distributor conduit 26, as shown in FIG. 2.

Figure 3:
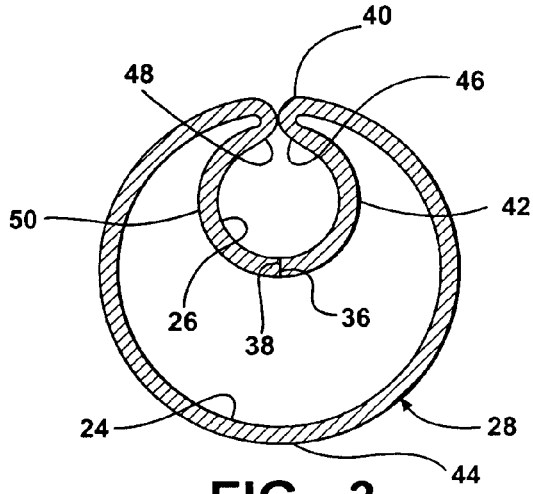
FIG. 3 is a cross section of a second exemplary embodiment taken along a line similar to 2-2 of FIG. 1.
Figure 4:
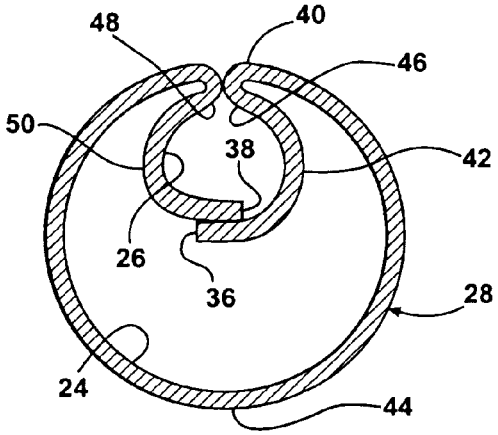
FIG. 4 is a cross section of an aspect of a second exemplary embodiment of a manifold taken along a line similar to 2-2 of FIG. 1.
Figure 5:
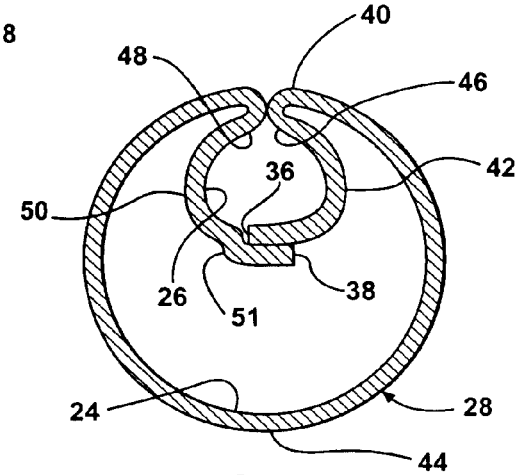
FIG. 5 is a cross section of an aspect of the second exemplary embodiment taken along a line similar to 2-2 of FIG. 1.

According to a second exemplary embodiment, a second fold 48 extends axially along the sheet 28 of a substantially "U"-shape as viewed in cross section. The second fold 48 abuts the first fold 46. A third bend 50 is placed between the second fold 48 and the trailing edge 38 to define a second portion of the distributor conduit 26. The first and second portions of the distributor conduit 26 are connected to define the distributor conduit 26 by placing the leading edge 36 into engagement with the trailing edge 38. According to a first aspect of the invention, the leading edge 36 abuts the trailing edge 38, as shown in FIG. 3. According to a second aspect of the invention, the leading and trailing edges 36, 38 overlap, as shown in FIGS. 4 and 5. In addition, a jog 51 can be formed intermediate the second fold 48 and the trailing edge 38 to receive the leading edge 36, as shown in FIG. 5.

Figure 6:
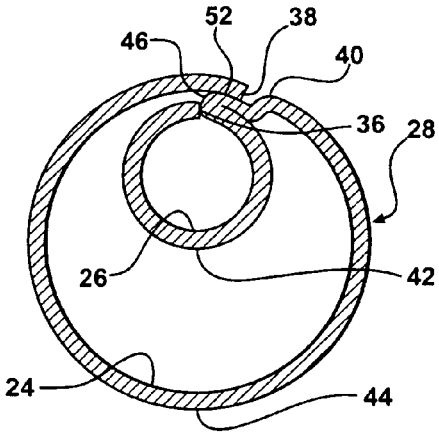
FIG. 6 is a cross section of a third exemplary embodiment of a manifold taken along a line similar to 2-2 of FIG. 1.
Figure 7:
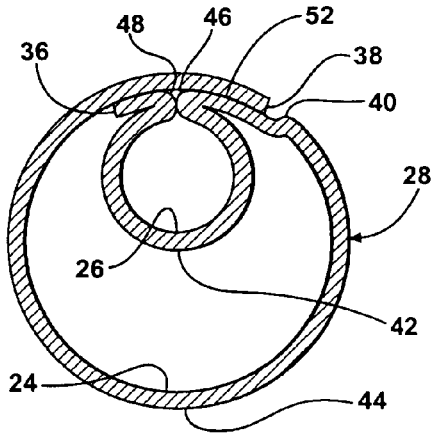
FIG. 7 is a cross section of an aspect of the third exemplary embodiment of a manifold taken along a line similar to 2-2 of FIG. 1.

According to a third exemplary embodiment, the first fold 46 extends axially in circumferentially spaced relationship to the leading shoulder 40, as shown generally in FIGS. 6, 7 and 11. It should be noted that the embodiment depicted in FIG. 11 is identical to that of FIG. 7, except that FIG. 11 shows one of a plurality of orifices 30 in cross section that was formed by lancing. The leading edge 36 engages the sheet 28 at the first fold 46 to define the distributor conduit 26. According to a third aspect of the present invention, the leading edge 36 abuts against the first fold 46 to define the distributor conduit 26, as shown in FIG. 6. According to a fourth aspect, a second fold 48 extends axially along the sheet 28 between the first fold 46 and the leading edge 36 of a substantially "U"-shape as viewed in cross section and abuts against the first fold 46 to define the distributor conduit 26, as shown in FIGS. 7 and 11.

Figure 8:
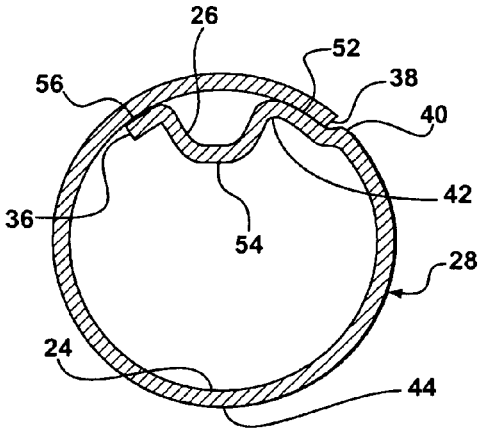
FIG. 8 is a cross section of fourth exemplary embodiment taken along a line similar to 2-2 of FIG. 1.
Figure 16:
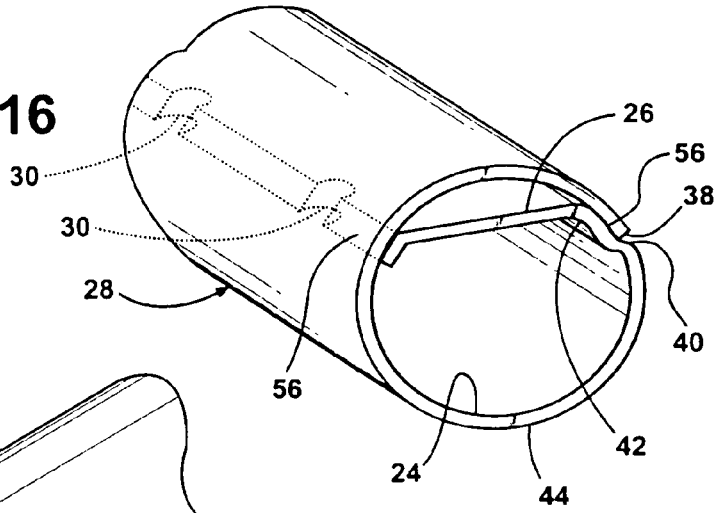
FIG. 16 is a perspective view of the exemplary manifold of FIG. 12.
Figure 17:
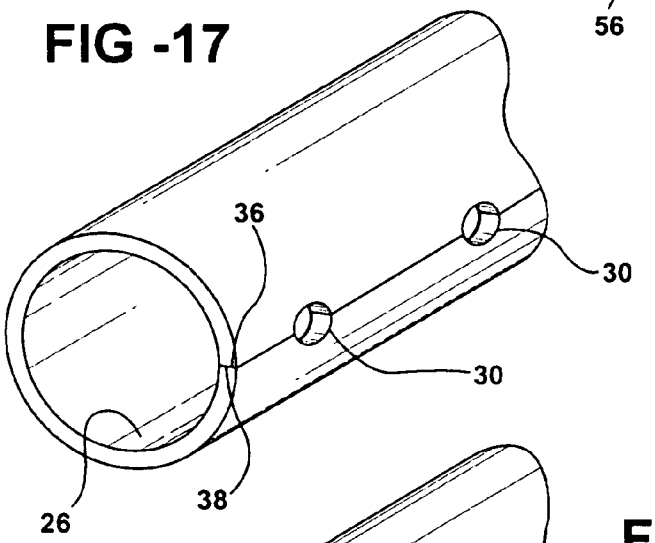
FIG. 17 is a perspective view of a distributor conduit with orifices formed along the edges.
Figure 18:
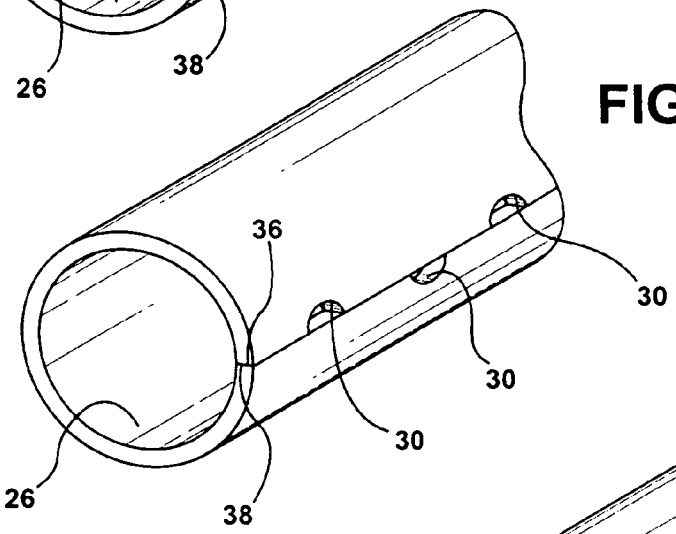
FIG. 18 is a perspective view of another distributor conduit with orifices staggered along the edges.
Figure 19:
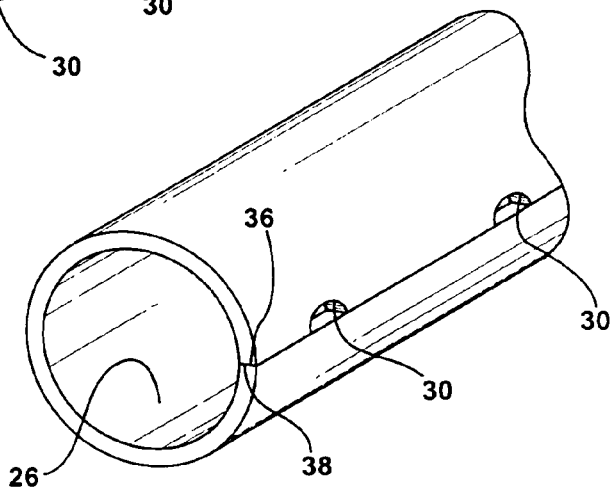
FIG. 19 is a perspective view of another distributor conduit with orifices formed along only one of the edges.

According to a fourth exemplary embodiment, a ledge 52 is offset radially inwardly and extends axially with the leading shoulder 40, as shown in FIGS. 6-14. The first bend 42 is positioned between the ledge 52 and the leading edge 36 to define at least the first portion of the distributor conduit 26. According to a fifth aspect of the present invention, as shown in FIGS. 8 and 13, the distributor conduit 26 includes a dip section 54 extending axially along the sheet 28 between the ledge 52 and the leading edge 36. It should be noted that the embodiment depicted in FIG. 13 is similar to that of FIG. 8, except that FIG. 13 shows one of a plurality of orifices 30 in cross section and also shows a radiused dip section 54 as compared with the flattened dip section 54 of FIG. 8. According to a sixth aspect, as shown in FIGS. 8, and 12-14, a flange 56 extends axially along the leading edge 36. It should be further noted that the embodiment depicted in FIGS. 12 and 14 is similar to that of FIGS. 8 and 13 except that the embodiment of FIGS. 12 and 14 lack the dip section 54. FIG. 12 illustrates one of a plurality of orifices 30 in cross section, and FIG. 14 illustrates the external coupler 34 for injecting fluid into the heat exchanger 20. The isometric view of FIG. 16 shows a plurality of the orifices 30 formed along the leading edge 36.

Figure 9:
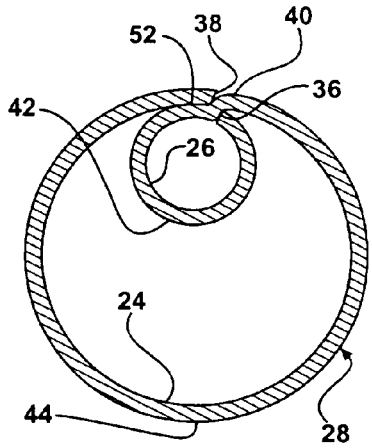
FIG. 9 is a cross section of a fifth exemplary embodiment taken along a line similar to 2-2 of FIG. 1.
Figure 10:
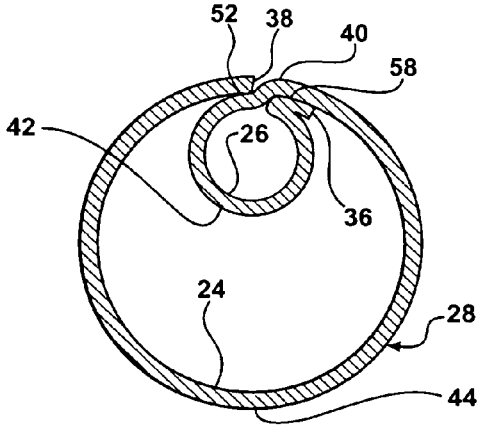
FIG. 10 is a cross section of an alternative of the fifth exemplary embodiment taken along a line similar to 2-2 of FIG. 1.

According to a fifth exemplary embodiment, as shown in FIGS. 9 and 10, the leading edge 36 engages the sheet 28 at the ledge 52 to define the distributor conduit 26. According to a seventh aspect of the present invention, the leading edge 36 abuts the ledge 52, as shown in FIG. 9. According to an eight aspect, a leading fold 58 extends axially along the sheet 28 along the leading edge 36 to define the distributor conduit 26. The leading fold 58 has a substantially "U"-shape as viewed in cross section and abuts against the ledge 52 to define the distributor conduit 26.

Referring next to FIG. 15, a method of fabricating the heat exchanger 20 according to the first exemplary embodiment is shown generally. Orifices 30 are formed along the leading edge 36 of a sheet 28 of material. The orifices 30 can be formed through any suitable method known in the art, including lancing, punching, drilling, and indenting. FIGS. 16-19 show some examples of indenting the sheet 28 to form orifices 30 along one or both edges 36, 38 of the sheet 28. The distributor conduit 26 is formed by bending the sheet 28 along the leading edge 36. According to a ninth first aspect of the present invention, the distributor conduit 26 is formed with the continuous sheet 28 to be fluidly isolated from the header 24 excepting the orifices 30 formed therein. The header 24 is formed by bending a remainder of the sheet 28 including the trailing edge 38 about an axis A in radially spaced relationship to the distributor conduit 26. The cross sections are completed by placing the leading and trailing edges 36, 38 into contact with, and sealing the edges 36, 38 to the sheet 28. To seal the edges 36, 38, a braze sheet 28 could be used. The braze sheet 28 can be clad on the inside, outside, or on both surfaces to seal the manifold 22. The embodiments shown in FIGS. 3-5, for example, could use either an outside or a both-side clad, while the embodiments of FIGS. 2, 6 and 10 could use either an inside or a both-side clad. The embodiments of FIGS. 7-9 and 11-14 could use either of the three. The bending can be achieved through any suitable method. One such method is known as roll forming, in which sets of roller dies (not shown) are used to bend the sheet 28 until the desired shape is achieved. The edges 36, 38 can be sealed by any suitable method, including soldering, welding and brazing. Tubes 32 are inserted between the headers 24 to establish fluid flow. If a clad braze sheet 28 is used to seal the edges 36, 38, the same brazing operation could be also used to braze the tubes 32 to form the completed assembly.

Referring generally to FIGS. 2-14, the bending step includes forming the leading shoulder 40 axially along the sheet 28 in spaced relationship to the leading edge 36. Placing the trailing edge 38 into contact with the sheet 28 is further defined as abutting the leading shoulder 40 with the sheet 28 to form the header 24. According to a tenth aspect of the present invention, the abutting is further defined as abutting the trailing edge 38 with the leading shoulder 40 to complete the cross sectional periphery of the header 24.

In accordance with the first exemplary embodiment, the bending step further includes bending a first section of the sheet 28 to form the first fold 46. The bending further includes forming the first bend 42 between the first fold 46 and the leading edge 36 to define at least a segment of the cross sectional periphery of the distributor conduit 26. The distributor conduit 26 is further formed by bending the first part of the sheet 28 between the first fold 46 and the leading edge 36 to place the leading edge 36 beneath and engaging the trailing edge 38 and abutting both edges 36, 38 against the leading shoulder 40 of the first fold 46, as shown specifically in FIG. 2.

In accordance with the second exemplary embodiment, the bending step includes bending a second section of the sheet 28 to form the second fold 48. The first fold 46 is abutted with the second fold 48, as shown in FIGS. 3-5. The bending further includes forming the third bend 50 between the second fold 48 and the trailing edge 38. Placing the edges 36, 38 into contact with the sheet 28 includes engaging the trailing edge 38 with the leading edge 36 to complete the cross sectional periphery of the distributor conduit 26. As shown in FIG. 3, the engaging can be defined as abutting the trailing edge 38 against the leading edge 36. As shown in FIGS. 4 and 5, the engaging can be defined as overlapping the edges 36, 38.

In accordance with the third exemplary embodiment, the first fold 46 is formed in circumferentially spaced relationship to the leading shoulder 40, as shown generally in FIGS. 6, 7 and 11. The distributor conduit 26 is formed by engaging the first portion of the sheet 28 with the first fold 46 to complete the cross sectional periphery of the distributor conduit 26. As shown in FIG. 6, the engaging can be defined as abutting the leading edge 36 against the first fold 46. As shown in FIG. 7, the first portion of the sheet 28 between the first fold 46 and the leading edge 36 is folded into a second fold 48 of substantially "U"-shape. The first fold 46 is then abutted with the second fold 48 to complete the cross sectional periphery of the distributor conduit 26.

In accordance with the fourth exemplary embodiment, the bending step further includes forming a ledge 52 offset radially inwardly from and extending axially with the leading shoulder 40, as shown in FIGS. 6-14. The header 24 is formed by overlapping the trailing edge 38 onto the ledge 52. As shown specifically in FIGS. 8 and 13, the distributor conduit 26 includes a dip section 54 and engages the leading edge 36 with the sheet 28 in circumferentially spaced relationship to the ledge 52 for defining the header 24 between the sheet 28 and the dip section 54. As shown in FIGS. 8, 12-14, a flange 56 is formed along the leading edge 36. The sheet 28 overlaps circumferentially with the flange 56. Additionally, the flange 56 is not shown in FIGS. 12 and 13 because each of those cross sections is taken through an orifice 30 formed as an indentation from the leading edge 36 of the sheet 28.

In accordance with the fifth exemplary embodiment, shown in FIGS. 9 and 10, a ledge 52 is shown as discussed above in the fourth embodiment. The distributor conduit 26 is formed by placing the leading edge 36 circumferentially aligned with and engaging the ledge 52 under the leading shoulder 40. As shown specifically in FIG. 9, placing the leading edge 36 can be defined as abutting the leading edge 36 circumferentially into contact with the ledge 52. As shown specifically in FIG. 10, the leading edge 36 can be folded into a leading fold 58 of a substantially "U"-shape and placed into contact with the ledge 52.

Finally, although the embodiments disclosed have described the distributor conduit 26 formed about the leading edge 36 and the header 24 formed by placing the trailing edge 38, it should be noted that the leading and trailing edges 36, 38 could be switched without altering the result.

Obviously, many modifications and variations of the present invention are possible in light of the above teachings. The invention may be practiced otherwise than as specifically described within the scope of the appended claims.

What is claimed is:

1. A method of fabricating a manifold for a heat exchanger of the type including a header having a cross sectional periphery extending axially and radially surrounding an axially extending distributor conduit having a cross sectional periphery, said method comprising;

bending at least a first portion of the cross sectional periphery of the distributor conduit along a leading edge of a sheet of material having a trailing edge, bending the sheet about an axis in radially spaced relationship to the distributor conduit to form the header, forming a leading shoulder axially along the sheet in spaced relationship to the leading edge, folding a first section of the sheet into a first fold of a substantially "U"-shape as viewed in cross section, folding a second section of the sheet into a second fold of substantially "U"-shape and abutting the first fold with the second fold, bending a second part of the sheet between the second fold and the trailing edge and engaging the trailing edge with the leading edge to complete the cross sectional periphery of the distributor conduit, and sealing the edges to the sheet axially therealong, wherein the bending the sheet is further defined as abutting the leading shoulder with the sheet to complete the cross sectional periphery of the header, wherein the bending of at least the first portion of the cross sectional periphery of the distributor conduit is further defined as bending a first part of the sheet between the first fold and the leading edge to define at least a segment of the cross sectional periphery of the distributor conduit, wherein the folding of the first fold includes forming the leading shoulder, and wherein the engaging is further defined as abutting the trailing edge against the leading edge.

2. A method of fabricating a manifold for a heat exchanger of the type including a header having a cross sectional periphery extending axially and radially surrounding an axially extending distributor conduit having a cross sectional periphery, said method comprising;

bending at least a first portion of the cross sectional periphery of the distributor conduit along a leading edge of a sheet of material having a trailing edge, bending the sheet about an axis in radially spaced relationship to the distributor conduit to form the header, forming a leading shoulder axially along the sheet in spaced relationship to the leading edge, folding a first section of the sheet into a first fold of a substantially "U"-shape as viewed in cross section, folding a second section of the sheet into a second fold of substantially "U"-shape and abutting the first fold with the second fold, and bending a second part of the sheet between the second fold and the trailing edge and engaging the trailing edge with the leading edge to complete the cross sectional periphery of the distributor conduit, and sealing the edges to the sheet axially therealong, wherein the bending the sheet is further defined as abutting the leading shoulder with the sheet to complete the cross sectional periphery of the header, wherein the bending of at least the first portion of the cross sectional periphery of the distributor conduit is further defined as bending a first part of the sheet between the first fold and the leading edge to define at least a segment of the cross sectional periphery of the distributor conduit, wherein the folding of the first fold includes forming the leading shoulder, and wherein the engaging is further defined as overlapping the edges.

3. A method as set forth in claim 2 further defined as bending a jog radially inwardly to receive the overlapped edge.

* * * * *